US011198995B2

(12) United States Patent
Dodd et al.

(10) Patent No.: US 11,198,995 B2
(45) Date of Patent: Dec. 14, 2021

(54) WASTE SYSTEM INCLUDING DISPOSAL WITH MULTIPLE INLETS

(71) Applicant: Moen Incorporated, North Olmsted, OH (US)

(72) Inventors: Christopher Douglas Dodd, Lakewood, OH (US); Matthew J. Lance, North Ridgeville, OH (US)

(73) Assignee: FB Global Plumbing Group LLC, North Olmsted, OH (US)

( * ) Notice: Subject to any disclaimer, the term of this patent is extended or adjusted under 35 U.S.C. 154(b) by 178 days.

(21) Appl. No.: 16/263,585

(22) Filed: Jan. 31, 2019

(65) Prior Publication Data

US 2020/0087907 A1 Mar. 19, 2020

Related U.S. Application Data

(60) Provisional application No. 62/732,125, filed on Sep. 17, 2018.

(51) Int. Cl.

| | |
|---|---|
| ***E03C 1/266*** | (2006.01) |
| ***B02C 18/00*** | (2006.01) |
| ***B02C 23/36*** | (2006.01) |

(52) U.S. Cl.

CPC ..... *E03C 1/2665* (2013.01); *B02C 18/0092* (2013.01); *B02C 23/36* (2013.01)

(58) Field of Classification Search

CPC ..... B02C 18/0092; B02C 23/36

See application file for complete search history.

(56) References Cited

U.S. PATENT DOCUMENTS

| | | | | |
|---|---|---|---|---|
| 2,498,502 | A * | 2/1950 | O'Brien | E03C 1/264 4/629 |
| 2,524,204 | A * | 10/1950 | O'Brien | E03C 1/26 4/629 |
| 2,584,423 | A * | 2/1952 | Collison | E03C 1/266 285/125.1 |
| 3,314,082 | A | 4/1967 | Minella | |
| 3,630,547 | A | 12/1971 | Hartshorn, Jr. | |
| 4,449,741 | A | 5/1984 | Litvin et al. | |
| 6,125,881 | A | 10/2000 | Hobbs et al. | |
| 6,601,248 | B1 | 8/2003 | Sage-Passant | |
| 6,629,652 | B2 | 10/2003 | Batten | |
| 6,651,863 | B1 | 11/2003 | Chen | |
| 6,971,400 | B1 * | 12/2005 | Bowman | E03C 1/12 137/216 |
| 8,033,486 | B2 * | 10/2011 | Berger | E03C 1/266 241/46.012 |
| 9,696,728 | B2 * | 7/2017 | Gormley | B02C 18/0084 |
| 10,471,438 | B2 * | 11/2019 | Chavez | B02C 18/12 |
| 2007/0251002 | A1 | 11/2007 | Schnitta | |
| 2010/0024121 | A1 | 2/2010 | Dille | |
| 2013/0206187 | A1 * | 8/2013 | Dombrowski | B08B 3/04 134/169 R |
| 2015/0115082 | A1 * | 4/2015 | Gormley | B02C 18/0092 241/46.016 |

(Continued)

*Primary Examiner* — Faye Francis
*Assistant Examiner* — Mohammed S. Alawadi
(74) *Attorney, Agent, or Firm* — Calfee, Halter & Griswold LLP

(57) ABSTRACT

The present invention provides a waste system including a disposal with multiple inlets that can receive water and waste materials from multiple basins.

20 Claims, 6 Drawing Sheets

(56) References Cited

U.S. PATENT DOCUMENTS

| | | | | |
|---|---|---|---|---|
| 2015/0369471 | A1* | 12/2015 | Williams | F21V 33/0044<br>241/46.014 |
| 2016/0002900 | A1* | 1/2016 | Gormley | B02C 18/0092<br>241/46.013 |
| 2016/0122981 | A1* | 5/2016 | Gormley | B02C 18/0092<br>137/605 |
| 2016/0200616 | A1* | 7/2016 | Platts | B02C 18/0092<br>210/113 |
| 2019/0003166 | A1* | 1/2019 | Britto | B02C 18/0092 |
| 2019/0210036 | A1* | 7/2019 | Chavez | B02C 18/0092 |

* cited by examiner

WASTE SYSTEM INCLUDING DISPOSAL WITH MULTIPLE INLETS

CROSS-REFERENCE TO RELATED APPLICATION

This application claims the benefit of U.S. Provisional Application No. 62/732,125, filed Sep. 17, 2018, the entire disclosure of which is hereby incorporated by reference.

FIELD

The present invention relates generally to a waste system including a disposal with multiple inlets and, more particularly, to a waste system including a disposal with multiple inlets that can receive water and waste materials from multiple basins.

BACKGROUND

Waste systems including a disposal with a single inlet that can receive water and waste materials from a single basin are known. These waste systems have various drawbacks. Consumers desire a waste system that eliminates these drawbacks.

SUMMARY

The present invention provides a waste system including a disposal with multiple inlets that can receive water and waste materials from multiple basins.

In an exemplary embodiment, the waste system comprises a disposal. The disposal includes a housing. The housing includes a first inlet, a second inlet, and an outlet. The first inlet is operable to fluidly connect to a first drain opening in a first basin. The first drain opening is operable to receive water and waste materials from the first basin. The second inlet is operable to fluidly connect to a second drain opening in a second basin. The second drain opening is operable to receive water and waste materials from the second basin. The disposal is operable to receive water and waste materials from both the first basin and the second basin.

In an exemplary embodiment, the waste system comprises a first basin, a second basin, and a disposal. The first basin includes a first drain opening. The first drain opening is operable to receive water and waste materials from the first basin. The second basin includes a second drain opening. The second drain opening is operable to receive water and waste materials from the second basin. The disposal includes a housing. The housing includes a first inlet, a second inlet, and an outlet. The first inlet is operable to fluidly connect to the first drain opening in the first basin. The second inlet is operable to fluidly connect to the second drain opening in the second basin. The disposal is operable to receive water and waste materials from both the first basin and the second basin.

DETAILED DESCRIPTION

The present invention provides a waste system including a disposal with multiple inlets that can receive water and waste materials from multiple basins.

Exemplary embodiments of a waste system 10 including a disposal with multiple inlets 12 of the present invention are shown in detail in FIGS. 1-6. The same reference numbers in combination with different letters (e.g., letters A, B, C, D, E, and F) will be used to identify the different embodiments. A reference number alone or in combination with the letter X will be used to generically identify all embodiments (e.g., embodiments A, B, C, D, E, and F as shown in FIGS. 1, 2, 3, 4, 5, and 6, respectively).

In exemplary embodiments, as shown in FIGS. 1-6, the disposal 12X includes a housing 14X. In exemplary embodiments, the housing 14X includes a first inlet 16X, a second inlet 18X, a grind chamber (internal), a motor chamber (internal), and an outlet 20X. In exemplary embodiments, the disposal 12X further includes a grind assembly (internal), a motor assembly (internal), and a mount assembly 22X. In exemplary embodiments, the grind assembly is located in the grind chamber, and the motor assembly is located in the motor chamber. In exemplary embodiments, the mount assembly 22X is operable to mount the disposal 12X in the waste system 10X. In exemplary embodiments, the housing 14X further includes an upper portion 24X and a lower portion 26X. These components of disposals are well-known in the art and will not be described in greater detail. Only the first inlet 16X, the second inlet 18X, the outlet 20X, and related components will be described in greater detail.

In exemplary embodiments, the disposal 12X includes a top 28X and a bottom 30X. In exemplary embodiments, as best shown in FIGS. 1, 2, 4, and 6, the first inlet 16X is located in the top 28X of the disposal 12X.

In exemplary embodiments, the upper portion 24X of the disposal 12X is generally an upper half of the disposal 12X, and the lower portion 26X of the disposal 12X is generally a lower half of the disposal 12X.

In exemplary embodiments, as best shown in FIGS. 1, 2, 4, and 6, the second inlet 18X is located in the upper portion 24X of the disposal 12X and, more specifically, generally in the upper half of the disposal 12X. In exemplary embodiments, as best shown in FIGS. 1, 2, 4, and 6, the second inlet 18X is located below the first inlet 16X.

Figure 3:
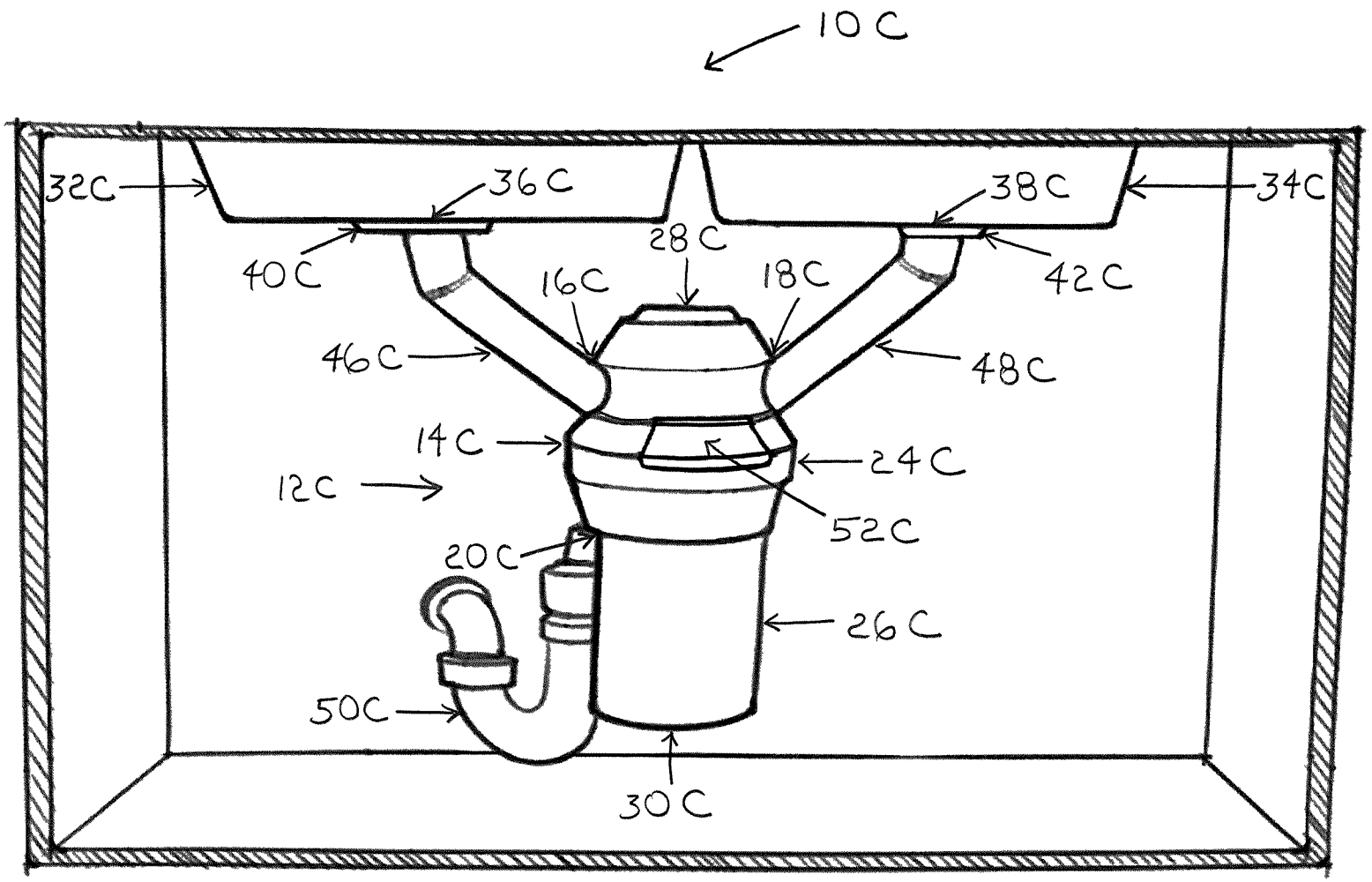
FIG. 3 is a front elevational view of a waste system including a disposal with multiple inlets according to a third exemplary embodiment of the present invention.
Figure 5:
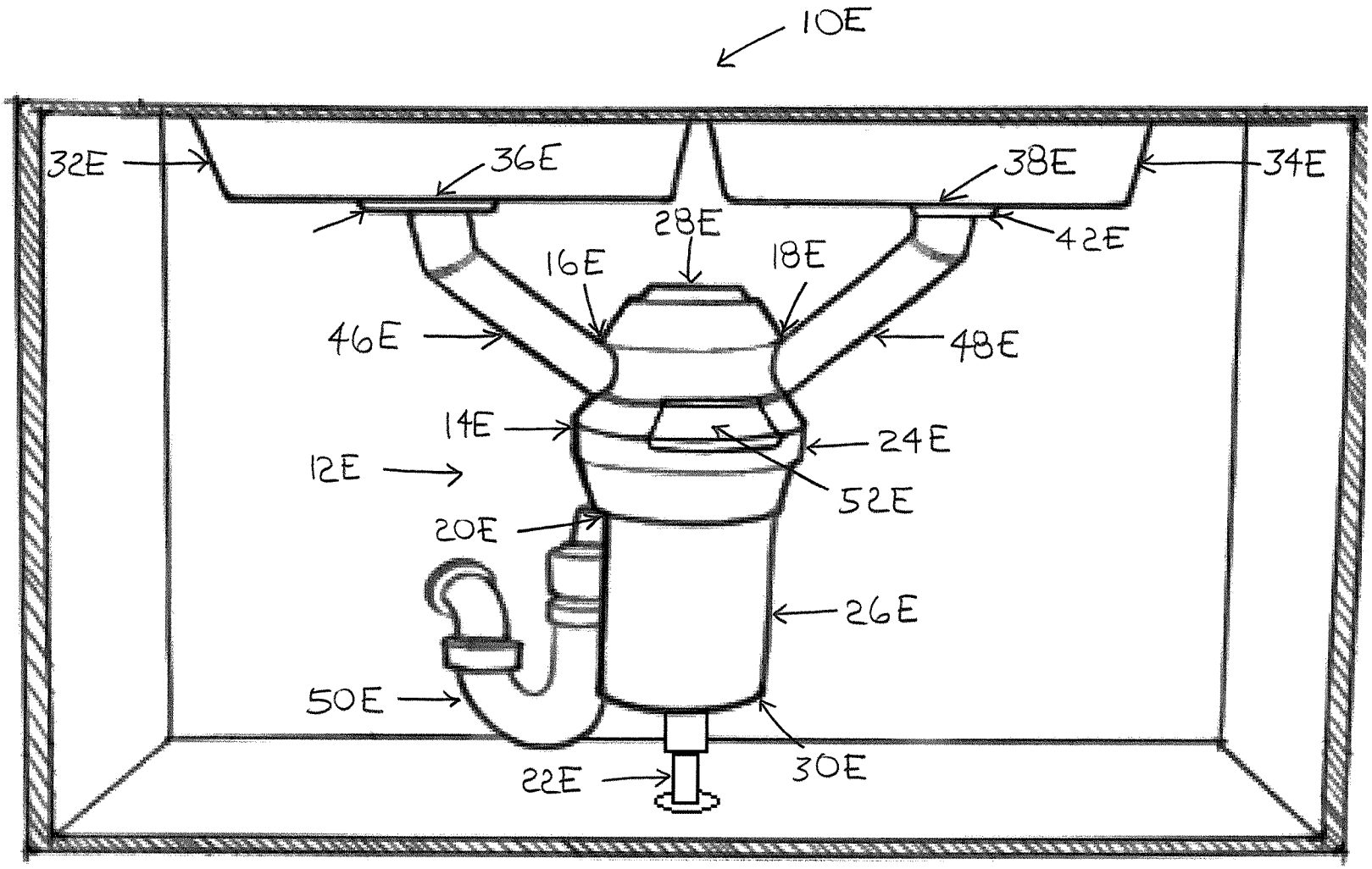
FIG. 5 is a front elevational view of a waste system including a disposal with multiple inlets according to a fifth exemplary embodiment of the present invention.

In exemplary embodiments, as best shown in FIGS. 3 and 5, both the first inlet 16X and the second inlet 18X are located in the upper portion 24X of the disposal 12X and, more particularly, generally in the upper half of the disposal 12X. In exemplary embodiments, as best shown in FIGS. 3 and 5, the first inlet 16X and the second inlet 18X are located at the same level.

In exemplary embodiments, as best shown in FIGS. 1-6, the outlet 20X is located below both the first inlet 16X and the second inlet 18X.

In exemplary embodiments, the disposal 12X is operable to receive water and waste materials from both a first basin 32X and a second basin 34X. In exemplary embodiments, as best shown in FIGS. 1, 2, 3, and 5, the first basin 32X includes a first drain opening 36X, and the second basin 34X includes a second drain opening 38X. In exemplary embodiments, as best shown in FIGS. 1, 2, 3, and 5, the first drain opening 36X is operable to receive a first drain flange 40X, and the second drain opening 38X is operable to receive a second drain flange 42X. In exemplary embodiments, the first drain opening 36X and the first drain flange 40X are operable to receive water and waste materials from the first basin 32X, and the second drain opening 38X and the second drain flange 42X are operable to receive water and waste materials from the second basin 34X.

Figure 1:
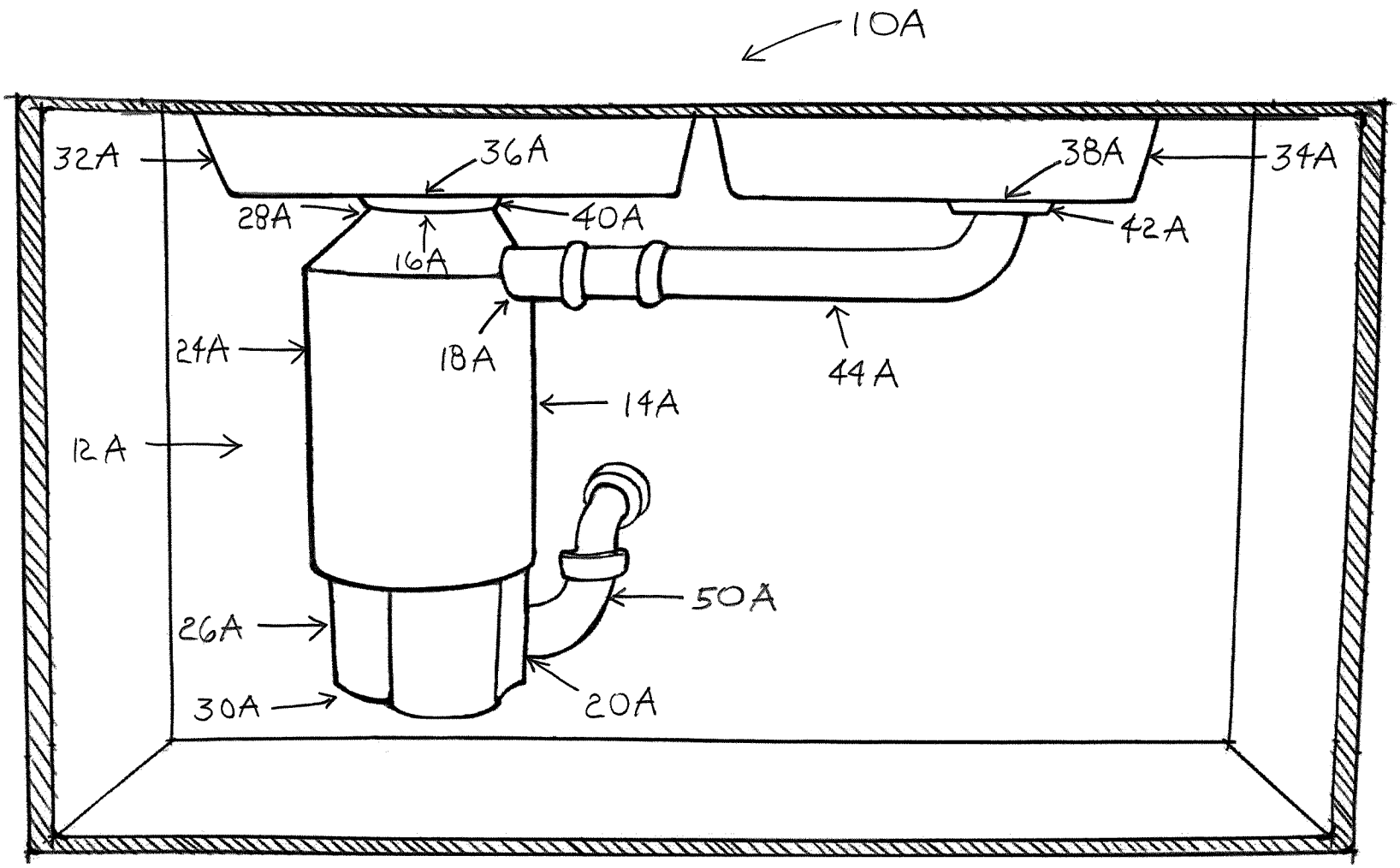
FIG. 1 is a front elevational view of a waste system including a disposal with multiple inlets according to a first exemplary embodiment of the present invention.
Figure 2:
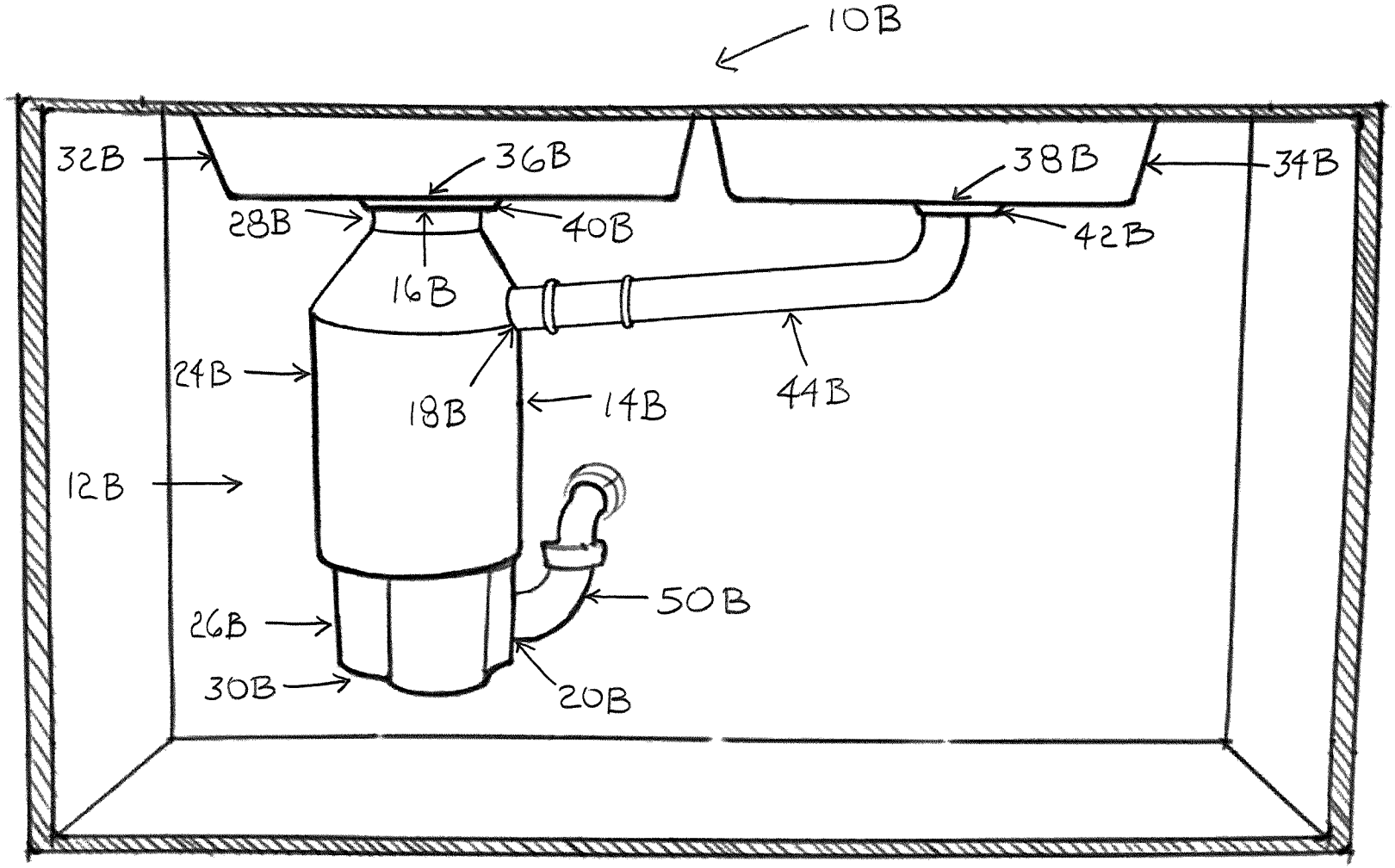
FIG. 2 is a front elevational view of a waste system including a disposal with multiple inlets according to a second exemplary embodiment of the present invention.

In exemplary embodiments, as best shown in FIGS. 1 and 2, the disposal 12X is operable to fluidly connect to the second drain opening 38X and the second drain flange 42X via a drain pipe 44X. In the exemplary embodiment as shown in FIG. 1, when the drain pipe 44A is installed and fluidly connecting the disposal 12A to the second drain opening 38A and the second drain flange 42A, the drain pipe 44A is generally straight or horizontal. In the exemplary embodiment as shown in FIG. 2, when the drain pipe 44B is installed and fluidly connecting the disposal 12B to the second drain opening 38B and the second drain flange 42B, the drain pipe 44B is generally angled or non-horizontal.

In exemplary embodiments, as best shown in FIGS. 3 and 5, the disposal 12X is operable to fluidly connect to the first drain opening 36X and the first drain flange 40X via a first drain pipe 46X, and the disposal 12X is operable to fluidly connect to the second drain opening 38X and the second drain flange 42X via a second drain pipe 48X. In the exemplary embodiments as shown in FIGS. 3 and 5, when the first drain pipe 46X is installed and fluidly connecting the disposal 12X to the first drain opening 36X and the first drain flange 40X, and the second drain pipe 48X is installed and fluidly connecting the disposal 12X to the second drain opening 38X and the second drain flange 42X, both the first drain pipe 46X and the second drain pipe 48X are generally angled or non-horizontal.

Figure 4:
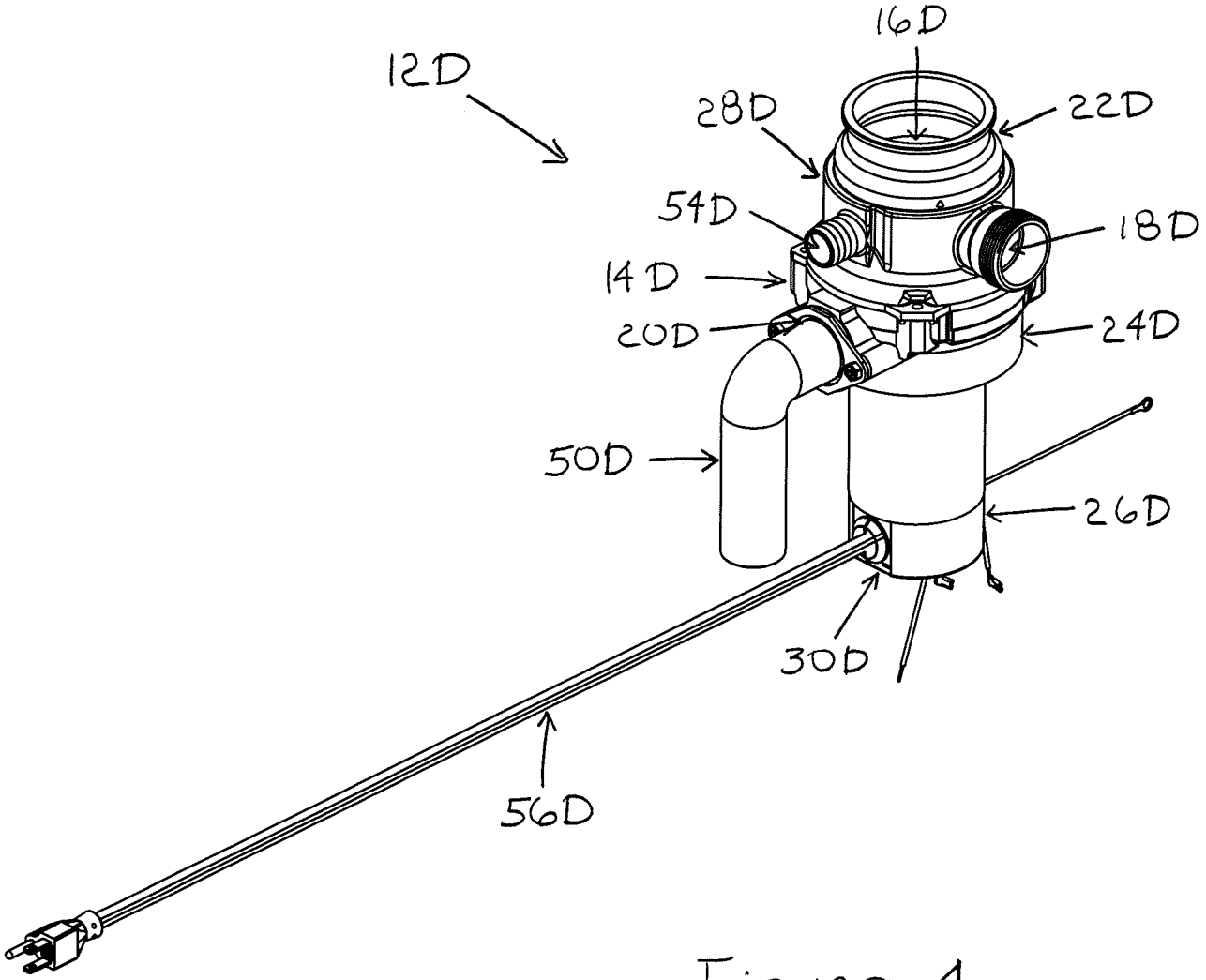
FIG. 4 is a front perspective view of a waste system including a disposal with multiple inlets according to a fourth exemplary embodiment of the present invention.

In exemplary embodiments, as best shown in FIGS. 4 and 5, the disposal 12X is operable to be mounted via the mount assembly 22X. In exemplary embodiments, the mount assembly 22X is attached to the top 28X of the disposal 12X, the bottom 30X of the disposal 12X, and/or around a periphery of the disposal 12X. In exemplary embodiments, the mount assembly 22X is attached to the first drain opening 36X and the first drain flange 40X and/or a wall or a floor of a cabinet in which the disposal 12X is mounted. In the exemplary embodiment as shown in FIG. 4, the mount assembly 22D is attached to the top 28D of the disposal 12D and, when mounted, would be attached to the first drain opening 36X and the first drain flange 40X. In the exemplary embodiment as shown in FIG. 5, the mount assembly 22E is attached to the bottom 30E of the disposal 12E and to the floor of the cabinet in which the disposal 12E is mounted.

In exemplary embodiments, as best shown in FIGS. 1-5, the disposal 12X is operable to fluidly connect to a sewer system via an outlet pipe 50X.

In exemplary embodiments, as best shown in FIGS. 3 and 5, the disposal 12X includes an access panel 52X in the housing 14X and, more specifically, generally in the upper portion 24X of the housing 14X. The access panel 52X enables a user to retrieve an object (such as a ring or other jewelry) that is accidentally received in the disposal 12X.

In an exemplary embodiment, as best shown in FIG. 4, the disposal 12D includes a dishwasher port 54D. The dishwasher port 54D enables the disposal 12D to be fluidly connected to a dishwasher.

In an exemplary embodiment, as best shown in FIG. 4, the disposal 12D includes a power cord 56D. The power cord 56D enables the disposal 12D to be electrically connected to a power source.

Figure 6:
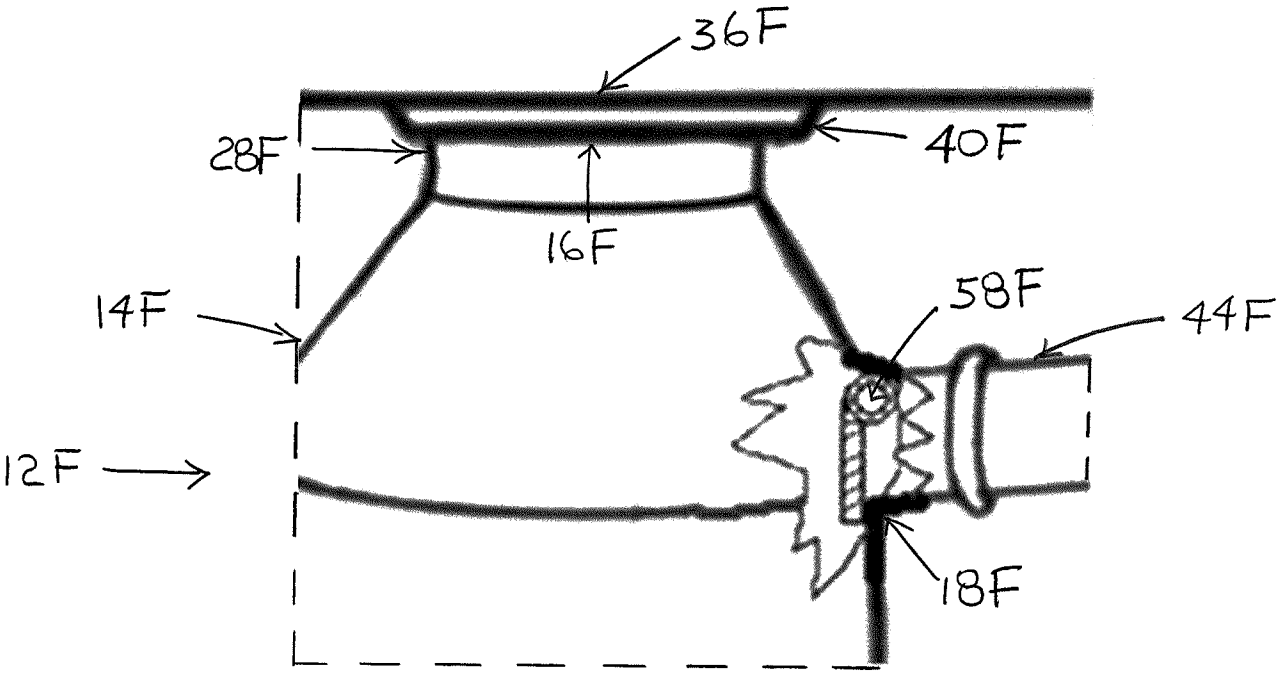
FIG. 6 is a front elevational view of a portion of a waste system including a disposal with multiple inlets according to a sixth exemplary embodiment of the present invention.

In exemplary embodiments, the disposal 12X includes a backflow prevention device 58X located in one of: (1) the second inlet 18X, and (2) the drain pipe 44X or the second drain pipe 48X fluidly connecting the disposal 12X to the second drain opening 38X and the second drain flange 42X. In an exemplary embodiment, as best shown in FIG. 6, the backflow prevention device 58F is located in the second inlet 18F. The backflow prevention device 58X prevents water backing up from the outlet 20X and into the second basin 34X through the second inlet 18X and the drain pipe 44X or the second drain pipe 48X fluidly connecting the disposal 12X to the second drain opening 38X and the second drain flange 42X. In exemplary embodiments, the back flow prevention device 58X is a check valve. However, one of ordinary skill in the art will appreciate that the backflow prevention device 58X could be any device that prevents water backing up from the outlet 20X and into the second basin 34X through the second inlet 18X and the drain pipe 44X or the second drain pipe 48X fluidly connecting the disposal 12X to the second drain opening 38X and the second drain flange 42X.

After installation, in the exemplary embodiments as shown in FIGS. 1 and 2, the first inlet 16A, 16B of the disposal 12A, 12B is fluidly connected to the first basin 32A, 32B through the first drain opening 36A, 36B and the first drain flange 40A, 40B. Additionally, the second inlet 18A, 18B of the disposal 12A, 12B is fluidly connected to the second basin 34A, 34B through the second drain opening 38A, 38B, the second drain flange 42A, 42B, and the drain pipe 44A, 44B.

After installation, in the exemplary embodiments as shown in FIGS. 3 and 5, the first inlet 16C, 16E of the disposal 12C, 12E is fluidly connected to the first basin 32C, 32E through the first drain opening 36C, 36E, the first drain flange 40C, 40E, and the first drain pipe 46C, 46E. Additionally, the second inlet 18C, 18E of the disposal 12C, 12E is fluidly connected to the second basin 34C, 34E through the second drain opening 38C, 38E, the second drain flange 42C, 42E, and the second drain pipe 48C, 48E.

During use, in the exemplary embodiments as shown in FIGS. 1 and 2, water and waste materials flow from the first basin 32A, 32B, through the first drain opening 36A, 36B and the first drain flange 40A, 40B, through the first inlet 16A, 16B, into the grind chamber, through the outlet 20A, 20B, and through the outlet pipe 50A,50B. Additionally, water and waste materials flow from the second basin 34A, 34B, through the second drain opening 38A, 38B and the second drain flange 42A, 42B, through the drain pipe 44A, 44B, through the second inlet 18A, 18B, into the grind chamber, through the outlet 20A, 20B, and through the outlet pipe 50A, 50B.

During use, in the exemplary embodiments as shown in FIGS. 3 and 5, water and waste materials flow from the first basin 32C, 32E, through the first drain opening 36C, 36E and the first drain flange 40C, 40E, through the first drain pipe 46C, 46E, through the first inlet 16C, 16E, into the grind chamber, through the outlet 20C, 20E, and through the outlet pipe 50C, 50E. Additionally, water and waste materials flow from the second basin 34C, 34E, through the second drain opening 38C, 38E and the second drain flange 42C, 42E, through the second drain pipe 48C, 48E, through the second inlet 18C, 18E, into the grind chamber, through the outlet 20C, 20E, and through the outlet pipe 50C, 50E.

While the waste system 10 and the disposal 12 have been shown and described in the illustrated embodiments as including certain components, one of ordinary skill in the art will appreciate that the waste system 10 and the disposal 12 do not need to include each of these components and/or the specifics of each of these components.

For example, while the housing 14X of the disposal 12X has been shown and described as including an upper portion 24X and a lower portion 26X, one of ordinary skill in the art will appreciate that the housing 14X could include a single portion or more than two portions.

One of ordinary skill in the art will now appreciate that the present invention provides a waste system including a disposal with multiple inlets that can receive water and waste materials from multiple basins. Although the present invention has been shown and described with reference to particular embodiments, equivalent alterations and modifications will occur to those skilled in the art upon reading and understanding this specification. The present invention includes all such equivalent alterations and modifications.

What is claimed is:

1. A waste system, comprising:

a disposal, the disposal including a housing, the housing including a first inlet, a second inlet, and an outlet;

the first inlet being operable to fluidly connect to a first basin, the first basin including an open top, closed sidewalls, and a bottom surface, the sidewalls of the first basin extending downwardly from a mounting surface, the bottom surface of the first basin including a first drain opening, the first drain opening being operable to receive a first drain flange, the first drain opening and the first drain flange being operable to receive water and waste materials from the first basin, the first inlet being operable to fluidly connect to the first drain opening and the first drain flange, the first inlet being operable to receive water and waste materials from the first basin;

the second inlet being operable to fluidly connect to a second basin, the second basin being adjacent the first basin, the second basin including an open top, closed sidewalls, and a bottom surface, the sidewalls of the second basin extending downwardly from the mounting surface, the bottom surface of the second basin including a second drain opening, the second drain opening being operable to receive a second drain flange, the second drain opening and the second drain flange being operable to receive water and waste materials from the second basin, the second inlet being operable to fluidly connect to the second drain opening and the second drain flange, the second inlet being operable to receive water and waste materials from the second basin;

whereby the disposal is operable to receive water and waste materials from both the first basin and the second basin.

2. The waste system of claim 1, wherein:

the disposal includes a top and a bottom; and the first inlet is located in the top of the disposal.

3. The waste system of claim 1, wherein:

the disposal includes an upper portion and a lower portion; and the second inlet is located in the upper portion of the disposal.

4. The waste system of claim 1, wherein the second inlet is located below the first inlet.

5. The waste system of claim 1, wherein:

the disposal includes an upper portion and a lower portion; and both the first inlet and the second inlet are located in the upper portion of the disposal.

6. The waste system of claim 1, wherein the first inlet and the second inlet are located at the same level.

7. The waste system of claim 1, wherein the outlet is located below both the first inlet and the second inlet.

8. The waste system of claim 1, wherein:

the disposal is operable to fluidly connect to the second drain opening via a drain pipe; and when the drain pipe is installed and fluidly connecting the disposal to the second drain opening, the drain pipe is horizontal.

9. The waste system of claim 1, wherein:

the disposal is operable to fluidly connect to the second drain opening via a drain pipe; and when the drain pipe is installed and fluidly connecting the disposal to the second drain opening, the drain pipe is generally non-horizontal.

10. A waste system, comprising:

a first basin, the first basin including an open top, closed sidewalls, and a bottom surface, the sidewalls of the first basin extending downwardly from a mounting surface, the bottom surface of the first basin including a first drain opening, the first drain opening being operable to receive a first drain flange, the first drain opening and the first drain flange being operable to receive water and waste materials from the first basin;

a second basin, the second basin being adjacent the first basin, the second basin including an open top, closed sidewalls, and a bottom surface, the sidewalls of the second basin extending downwardly from the mounting surface, the bottom surface of the second basin including a second drain opening, the second drain opening being operable to receive a second drain flange, the second drain opening and the second drain flange being operable to receive water and waste materials from the second basin; and a disposal, the disposal including a housing, the housing including a first inlet, a second inlet, and an outlet, the first inlet being operable to fluidly connect to the first drain opening and the first drain flange, the first inlet being operable to receive water and waste materials from the first basin, the second inlet being operable to fluidly connect to the second drain opening and the second drain flange, the second inlet being operable to receive water and waste materials from the second basin;

whereby the disposal is operable to receive water and waste materials from both the first basin and the second basin.

11. The waste system of claim 10, wherein:

the disposal includes a top and a bottom; and the first inlet is located in the top of the disposal.

12. The waste system of claim 10, wherein:

the disposal includes an upper portion and a lower portion; and the second inlet is located in the upper portion of the disposal.

13. The waste system of claim 10, wherein the second inlet is located below the first inlet.

14. The waste system of claim 10, wherein:

the disposal includes an upper portion and a lower portion; and both the first inlet and the second inlet are located in the upper portion of the disposal.

15. The waste system of claim 10, wherein the first inlet and the second inlet are located at the same level.

16. The waste system of claim 10, wherein the outlet is located below both the first inlet and the second inlet.

17. The waste system of claim 10, further including a drain pipe, wherein:

the disposal is fluidly connected to the second drain opening via the drain pipe; and when the drain pipe is installed and fluidly connecting the disposal to the second drain opening, the drain pipe is horizontal.

18. The waste system of claim 10, further including a drain pipe, wherein:

the disposal is fluidly connected to the second drain opening via the drain pipe; and when the drain pipe is installed and fluidly connecting the disposal to the second drain opening, the drain pipe is generally non-horizontal.

19. A waste system, comprising:

a disposal, the disposal including a housing, the housing including a first inlet, a second inlet, a dishwasher port, and an outlet;

the first inlet being operable to fluidly connect to a first basin, the first basin including an open top, closed sidewalls, and a bottom surface, the sidewalls of the first basin extending downwardly from a mounting surface, the bottom surface of the first basin including a first drain opening, the first drain opening being operable to receive a first drain flange, the first drain opening and the first drain flange being operable to receive water and waste materials from the first basin, the first inlet being operable to fluidly connect to the first drain opening and the first drain flange, the first inlet being operable to receive water and waste materials from the first basin;

the second inlet being operable to fluidly connect to a second basin, the second basin being adjacent the first basin, the second basin including an open top, closed sidewalls, and a bottom surface, the sidewalls of the second basin extending downwardly from the mounting surface, the bottom surface of the second basin including a second drain opening, the second drain opening being operable to receive a second drain flange, the second drain opening and the second drain flange being operable to receive water and waste materials from the second basin, the second inlet being operable to fluidly connect to the second drain opening and the second drain flange, the second inlet being operable to receive water and waste materials from the second basin;

the dishwasher port being operable to fluidly connect to a dishwasher, the dishwasher port being operable to receive water and waste materials from the dishwasher;

whereby the disposal is operable to receive water and waste materials from the first basin, the second basin, and the dishwasher.

20. The waste system of claim 19, wherein the second inlet and the dishwasher port are located at the same level.

* * * * *